US009440410B2

(12) United States Patent
Marshall

(10) Patent No.: US 9,440,410 B2
(45) Date of Patent: Sep. 13, 2016

(54) CARDBOARD CONTAINER

(75) Inventor: Neil Marshall, Fareham Hants (GB)

(73) Assignee: HUHTAMAKI OYJ, Espoo (FI)

( * ) Notice: Subject to any disclaimer, the term of this patent is extended or adjusted under 35 U.S.C. 154(b) by 572 days.

(21) Appl. No.: 13/382,874

(22) PCT Filed: Jul. 6, 2010

(86) PCT No.: PCT/EP2010/004072

§ 371 (c)(1),
(2), (4) Date: Jan. 6, 2012

(87) PCT Pub. No.: WO2011/003569

PCT Pub. Date: Jan. 13, 2011

(65) Prior Publication Data

US 2012/0111877 A1 May 10, 2012

(30) Foreign Application Priority Data

Jul. 6, 2009 (DE) ..... 10 2009 026 108
Dec. 4, 2009 (DE) ..... 10 2009 044 772
Apr. 9, 2010 (DE) ..... 10 2010 016 390

(51) Int. Cl.
*B31F 1/00* (2006.01)
*B65D 3/22* (2006.01)
(Continued)

(52) U.S. Cl.
CPC ..... *B31F 1/0038* (2013.01); *B31B 1/25* (2013.01); *B31B 1/28* (2013.01); *B31B 15/00* (2013.01); *B31B 17/00* (2013.01); *B31B 45/00* (2013.01); *B31F 1/10* (2013.01); *B65D 1/265* (2013.01); *B65D 3/22* (2013.01); *B65D 81/3869* (2013.01); *B65D 81/3876* (2013.01); *B31B 2201/255* (2013.01); *B31B 2201/257* (2013.01); *B31B 2201/2604* (2013.01); *B31B 2201/2695* (2013.01); *B31B 2217/003* (2013.01); *B31B 2217/062* (2013.01); *B31B 2217/064* (2013.01); *B31B 2217/082* (2013.01); *B31B 2217/108* (2013.01)

(58) Field of Classification Search
CPC ..... B65D 3/22; B65D 3/00; B65D 1/265; B65D 81/3876; B65D 81/3881; B65D 81/3865; B65D 81/3869
USPC ..... 220/62.19–62.2, 651–654, 669–674; 229/400–405
See application file for complete search history.

(56) References Cited

U.S. PATENT DOCUMENTS 1,091,526 A * 3/1914 Moore ..... 229/5.5
1,137,039 A * 4/1915 Weber ..... 206/217
(Continued)

FOREIGN PATENT DOCUMENTS

AT 54111 E 2/1991
DE 1432189 A 2/1969
(Continued)

*Primary Examiner* — Anthony Stashick
*Assistant Examiner* — Mollie Llewellyn
(74) *Attorney, Agent, or Firm* — Husch Blackwell LLP

(57) ABSTRACT

The present invention relates to a container, particularly a cup, with a base and a first sidewall, wherein the first sidewall comprises at least a first, at least partially circumferential shaping directed inwardly and/or outwardly. The container may also include a second sidewall attached to the shaping of the first sidewall at a connection point thereby providing an air gap between the first sidewall and second sidewall. The shaping of the first sidewall may include a tip to which the second sidewall is sealed or glued.

13 Claims, 20 Drawing Sheets

(51) Int. Cl.

| | |
|---|---|
| ***B65D 81/38*** | (2006.01) |
| ***B31B 1/25*** | (2006.01) |
| ***B31B 1/28*** | (2006.01) |
| ***B31B 15/00*** | (2006.01) |
| ***B31B 17/00*** | (2006.01) |
| ***B31B 45/00*** | (2006.01) |
| ***B31F 1/10*** | (2006.01) |
| ***B65D 1/26*** | (2006.01) |

(56) References Cited

U.S. PATENT DOCUMENTS

| | | | | |
|---|---|---|---|---|
| 1,571,208 | A * | 2/1926 | Lindgren | 220/62.2 |
| 2,028,566 | A * | 1/1936 | Seipel et al. | 294/31.2 |
| 2,090,435 | A * | 8/1937 | Waldvogel | 206/592 |
| 2,139,143 | A * | 12/1938 | Wiswell | 222/82 |
| 2,266,828 | A * | 12/1941 | Sykes | 220/1.5 |
| 2,622,051 | A * | 12/1952 | Hermanson et al. | 428/154 |
| 2,905,350 | A * | 9/1959 | Edwards | 215/373 |
| 3,079,027 | A * | 2/1963 | Edwards | 206/519 |
| 3,157,335 | A * | 11/1964 | Maier | 229/400 |
| 3,186,850 | A * | 6/1965 | Anthony | 426/86 |
| 3,201,111 | A * | 8/1965 | Afton | 267/153 |
| 3,223,305 | A * | 12/1965 | Edwards | 229/400 |
| 3,288,340 | A * | 11/1966 | Shapiro et al. | 206/519 |
| 3,372,830 | A * | 3/1968 | Edwards | 206/519 |
| 3,456,860 | A * | 7/1969 | Janninck | 229/400 |
| 3,472,418 | A * | 10/1969 | Ullman | 220/672 |
| 3,495,736 | A * | 2/1970 | Ragettli | 220/670 |
| 3,512,677 | A * | 5/1970 | Kovac | 206/520 |
| 3,927,766 | A | 12/1975 | Day | |
| 3,939,887 | A * | 2/1976 | Scarnato | 220/666 |
| 4,040,537 | A * | 8/1977 | Edwards | 206/520 |
| 4,156,483 | A * | 5/1979 | Day | 206/217 |
| 4,237,939 | A * | 12/1980 | Schwarz | 138/109 |
| 4,324,340 | A | 4/1982 | Belokin, Jr. | |
| 4,368,818 | A * | 1/1983 | Day et al. | 206/217 |
| 4,420,081 | A * | 12/1983 | Dart | 206/519 |
| 4,548,349 | A * | 10/1985 | Tunberg | 229/800 |
| 4,609,113 | A | 9/1986 | Seki | |
| 4,657,141 | A * | 4/1987 | Sorensen | 206/519 |
| 4,993,580 | A * | 2/1991 | Smith | 220/1.5 |
| RE33,608 | E * | 6/1991 | Sorensen | 206/519 |
| 5,125,512 | A * | 6/1992 | O'Leary | 206/517 |
| 5,397,021 | A * | 3/1995 | Usui | 220/667 |
| 5,415,339 | A * | 5/1995 | Howard | 229/403 |
| 5,490,631 | A * | 2/1996 | Iioka et al. | 229/403 |
| 5,669,553 | A * | 9/1997 | Smith | 229/403 |
| 5,725,916 | A * | 3/1998 | Ishii et al. | 428/34.2 |
| 5,766,709 | A * | 6/1998 | Geddes et al. | 428/35.7 |
| 5,769,311 | A * | 6/1998 | Morita et al. | 229/403 |
| 5,772,111 | A * | 6/1998 | Kirsch | 229/403 |
| 5,820,016 | A * | 10/1998 | Stropkay | 229/403 |
| 5,911,360 | A * | 6/1999 | Schellenberg | 229/404 |
| 5,950,917 | A * | 9/1999 | Smith | 229/403 |
| 5,964,400 | A * | 10/1999 | Varano et al. | 229/403 |
| 6,039,682 | A * | 3/2000 | Dees et al. | 493/58 |
| 6,186,394 | B1 * | 2/2001 | Dees et al. | 229/122.34 |
| 6,193,098 | B1 * | 2/2001 | Mochizuki et al. | 220/592.17 |
| 6,224,954 | B1 * | 5/2001 | Mitchell et al. | 428/34.2 |
| 6,253,995 | B1 * | 7/2001 | Blok et al. | 229/403 |
| 6,260,756 | B1 * | 7/2001 | Mochizuki et al. | 229/402 |
| 6,287,247 | B1 * | 9/2001 | Dees et al. | 493/58 |
| 6,497,338 | B1 * | 12/2002 | Stolzman | 220/628 |
| 6,536,657 | B2 * | 3/2003 | Van Handel | 229/403 |
| 6,554,154 | B1 * | 4/2003 | Chauhan et al. | 220/671 |
| 6,586,075 | B1 * | 7/2003 | Mitchell et al. | 428/159 |
| 6,588,654 | B2 * | 7/2003 | Nakashima | 229/402 |
| 6,598,786 | B1 * | 7/2003 | Guo | 229/403 |
| 6,663,926 | B1 | 12/2003 | Okushita et al. | |
| 6,718,664 | B2 * | 4/2004 | Williams | 40/324 |
| 6,729,534 | B2 * | 5/2004 | Van Handel | 229/403 |
| 6,926,197 | B2 * | 8/2005 | Hed et al. | 229/403 |
| 7,175,585 | B2 * | 2/2007 | Okushita et al. | 493/269 |
| 7,281,649 | B2 * | 10/2007 | Pyper, Jr. | 229/400 |
| 7,389,720 | B2 * | 6/2008 | Haverstock | 99/297 |
| 7,458,504 | B2 * | 12/2008 | Robertson et al. | 229/403 |
| 7,464,856 | B2 * | 12/2008 | Van Handel | 229/403 |
| 7,464,857 | B2 * | 12/2008 | Van Handel | 229/403 |
| 7,600,669 | B2 * | 10/2009 | Van Handel | 229/403 |
| 7,618,359 | B2 * | 11/2009 | Okushita et al. | 493/155 |
| 7,677,435 | B2 * | 3/2010 | Stahlecker | 229/403 |
| 7,699,216 | B2 * | 4/2010 | Smith et al. | 229/403 |
| 7,922,071 | B2 * | 4/2011 | Robertson et al. | 229/403 |
| 7,993,254 | B2 * | 8/2011 | Robertson et al. | 493/111 |
| 8,006,861 | B2 * | 8/2011 | Kim | 220/737 |
| 8,146,796 | B2 * | 4/2012 | D'Amato | 206/505 |
| 8,360,263 | B2 * | 1/2013 | D'Amato | 220/592.17 |
| 2002/0130170 | A1 * | 9/2002 | Nakashima | 229/402 |
| 2003/0015582 | A1 * | 1/2003 | Handel | 229/403 |
| 2003/0121189 | A1 * | 7/2003 | Williams | 40/324 |
| 2003/0121963 | A1 * | 7/2003 | Van Handel | 229/403 |
| 2004/0188450 | A1 * | 9/2004 | Marshall et al. | 220/737 |
| 2004/0226948 | A1 * | 11/2004 | Okushita et al. | 220/62.18 |
| 2005/0040218 | A1 * | 2/2005 | Hinchey et al. | 229/403 |
| 2005/0258225 | A1 * | 11/2005 | Martin | 229/403 |
| 2006/0027640 | A1 * | 2/2006 | Smith et al. | 229/400 |
| 2007/0117702 | A1 * | 5/2007 | Okushita et al. | 493/155 |
| 2007/0228134 | A1 * | 10/2007 | Cook et al. | 229/403 |
| 2008/0029588 | A1 * | 2/2008 | Messerschmid et al. | 229/400 |
| 2008/0087715 | A1 * | 4/2008 | Robertson et al. | 229/403 |
| 2008/0090711 | A1 * | 4/2008 | Robertson et al. | 493/111 |
| 2008/0121681 | A1 * | 5/2008 | Wiedmeyer | 229/403 |
| 2008/0128481 | A1 * | 6/2008 | Robertson | 229/403 |
| 2008/0290103 | A1 * | 11/2008 | Robertson et al. | 220/737 |
| 2009/0321460 | A1 * | 12/2009 | Kim | 220/738 |
| 2009/0321508 | A1 * | 12/2009 | Fu et al. | 229/403 |
| 2011/0272459 | A1 * | 11/2011 | Hoekstra et al. | 229/400 |
| 2012/0104004 | A1 * | 5/2012 | Marshall | 220/660 |

FOREIGN PATENT DOCUMENTS

| | | | |
|---|---|---|---|
| DE | 8601943 | U1 | 5/1986 |
| DE | 102004056932 | A1 | 5/2006 |
| DE | 69937440 | T2 | 8/2008 |
| DE | 102008014878 | A1 | 9/2009 |
| EP | 1031514 | A1 | 8/2000 |
| EP | 1227042 | A1 | 7/2002 |
| EP | 1227043 | A1 | 7/2002 |
| GB | 1480545 | A | 7/1977 |
| GB | 2075462 | A | 11/1981 |
| JP | 2003128038 | A | 5/2003 |
| WO | 9911526 | A1 | 3/1999 |
| WO | 0017058 | A1 | 3/2000 |
| WO | 2007054179 | A2 | 5/2007 |
| WO | 2008009371 | A1 | 1/2008 |

* cited by examiner

CARDBOARD CONTAINER

CROSS-REFERENCE TO RELATED APPLICATIONS

None.

FIELD OF THE INVENTION

The present invention relates to a container, particularly a cup, with a base and a first sidewall, whereas the first sidewall comprises at least a first, at least partially circumferential shaping directed inwardly and/or outwardly.

BACKGROUND OF THE INVENTION

Cardboard containers are known from the state of the art, for example from EP 1 227 043 B1, EP 1 227 042 B1 or U.S. Pat. No. 6,663,926. However, the cardboard described in the state of art are often difficult to produce, have an insufficient stability and/or are not well insulated.

It was therefore the objective of the present invention to provide a container that does not have the deficiencies of containers according to the state of the art.

SUMMARY OF THE INVENTION

In order to attain the above-described objective, a container, particularly a cup, with a base and a first sidewall is provided, whereas the first sidewall comprises at least a first, at least partially circumferential shaping directed inwardly and/or outwardly, which is, at least partially, compressed in its height extension.

The disclosure made to this embodiment of the present invention also applies to other embodiments of the present invention and vice versa.

The present invention relates to a container. Particularly, the container is a cup, in which beverages, especially hot beverages such as coffee or tea or food, especially soup can be served. This container is preferably made of paper, thick paper, cardboard, fiber-material, plastic-material, materials made from renewable and/or biodegradable raw materials or a combination thereof. However, paper and cardboard are preferred. Preferably, the material is plastically deformable, preferably embossable and more preferably also elastically deformable. All parts of the inventive container are made from this material, whereas the individual parts of the container can be made from different materials.

Especially the surfaces of parts of the container which are subjected to a liquid and/or vapour are provided with means, especially a coating, an impregnation, a film or the like, which makes the parts at least temporarily resistant against for example humidity, water, aqueous solutions, oil and/or fat or a combination thereof. Preferably the above mentioned means are also heat sealable.

The container according to the present invention comprises a first sidewall, which is, preferably, conically shaped and which, more preferably, has, at its upper end, a rolled rim. The first sidewall is preferably made from a flat segment, preferably a cardboard-segment, which is subsequently formed, preferably rolled into its final, preferably conical shape. Preferably at its lower end, the sidewall is connected to a base, in order to close the container at the bottom. The base is preferably a separate part, which is attached, more preferably glued or heat sealed, to the lower end of the sidewall of the container.

According to the present invention, the first sidewall comprises at least a first shaping, which extends at least partially, preferably entirely, around the circumference of the first sidewall. This shaping can be directed inwardly and/or outwardly, i.e. towards the content of the container and/or away from the content of the container. The shaping can alternate between an inward direction and an outward direction. This alternation is preferably harmonic. This shaping can be produced by any technique known by a person skilled in the art, e.g. by folding or any other method of plastic deformation. Preferably, the shaping is inserted into the segment before it is formed, e.g. rolled, into the final shape of the sidewall. More preferably the shaping is an embossment, which is produced for example by applying locally pressure to the sidewall and deforming the material of the sidewall plastically. The shaping can have any form known by a person skilled in the art. However, it should be compressible, at least partially, especially in case an axial-force, preferably axial pressure, is applied to the sidewall. Preferably, the shaping is U-shaped or has, at least partially, the shape of a segment of a circle. This shaping is now, according to present invention, compressed in its height extension, i.e. after the compression of the shaping, the sidewall is reduced in its height. Due to the compression of the shaping in its height, preferably the radial extension of the shaping increases at least partially. More preferably, the compression of the shaping is elastic, i.e. as soon as the deformation force is removed, the shaping resumes, at least partially, its original shape. Thus, in this preferred embodiment of the present invention, the deformed shaping functions as a spring.

Preferably, the inventive container comprises means to maintain the shaping in its compressed shape. This means is preferably a second sidewall, which is connected to the first sidewall and which maintains the shaping in its compressed state. The second sidewall can be inside or outside the first sidewall. The two sidewalls are preferably connected in two or more different areas, especially at two or more different heights of the container. The shaping itself or other parts of the first sidewall can be connected with the second sidewall.

According to another or a preferred embodiment of the present invention, the second sidewall is subjected to a tension, especially an axial tension. This tension increases the stiffness of the first and/or second sidewall. This tension is preferably introduced into the second sidewall due to the connection of the first sidewall to the second sidewall and the spring-like behaviour of the shaping in the first sidewall.

The disclosure made to this embodiment of the present invention also applies to other embodiments of the present invention and vice versa.

Preferably, the tension in the second sidewall is provided between two connections between the first and the second sidewall which are located at different heights Preferably, the first and the second sidewall have, at least partially, a different angle of inclination. Preferably, the angle of the first sidewall relative to the middle axis of the container is smaller than the angle of the second sidewall relative to the middle axis. This preferred feature of the present invention improves denesting of stacked containers.

Preferably, connection between the first and the second sidewall is formed by gluing, sealing, welding or mechanical locking.

Preferably, there is an air gap between the first and second sidewall, especially for the purpose of heat-insulation.

Preferably the first and/or the second sidewall comprise at least one additional second shaping which is arranged at a different height of the container. Preferably, the second shaping is also compressed in its height. The disclosure made regarding the first shaping also applies to the second shaping. More preferably, the first and the second shaping differ, especially after their compression, in their radial extension, whereas, preferably, the radial extension increases with the height of the container. This feature allows, for example, to provide the second sidewall at a different angle of inclination than the first sidewall.

Preferably, one sidewall comprises a shaping, which is in contact with a shaping worked into the other sidewall, especially to maintain at least the shaping of one sidewall in its compressed state.

In a preferred embodiment of the present invention, part of the first or second sidewall can be detached. Hereby, for example, a coupon can be formed, which shows information after it is removed. The coupon can be arranged at an edge of the sidewall or within the sidewall and can be removed partly or completely. The coupon does not influence the stability of the sidewall.

In order to also attain the above described objective, a container with a first sidewall, a second sidewall and a bottom is provided, whereas the angle of inclination of the first sidewall is larger than the angle of inclination of the second sidewall.

The disclosure made to this embodiment of the present invention also applies to other embodiments of the present invention and vice versa.

The container according to this present invention comprises a first sidewall, which is preferably conically shaped and which more preferably has at its upper end a rolled rim. The first sidewall is preferably made from a flat segment, preferably a cardboard segment, which is subsequently formed, preferably rolled into its conical shape. Preferably at its lower end, the sidewall is connected to a base in order to close the container at the bottom. The base is preferably a separate part which is attached, more preferably glued or heat sealed to the lower end of the first sidewall of the container.

Furthermore, the inventive container comprises a second sidewall, which is preferably arranged around the first sidewall. This second sidewall is preferably conically shaped and is more preferably made from a flat segment, preferably a cardboard segment, which is subsequently formed, especially rolled around the circumference of the first sidewall.

According to the present invention, the angle of inclination of the first sidewall is larger than the angle of inclination of the second sidewall. Due to this difference in angles of inclination, an air gap between the first and the second sidewall is formed, which provides good insulation. Furthermore, the stackability of the inventive container is improved.

Preferably, the second sidewall is connected to the first sidewall and/or the base at one, preferable two or more connection points or connection areas. This connection can be purely mechanical, based on adhesion or a combination thereof. Preferably, the two sidewalls are glued or sealed together.

Preferably, a spacer is arranged between the first and the second sidewall, especially to maintain the air gap between the first and the second sidewall, even if the second sidewall is subjected to pressure, for example by the hand of a user.

According to a preferred embodiment of the present invention, this spacer is a plastic shaping, preferably an embossment in the first and/or second sidewall. Preferably, this shaping extends at least partially, preferably entirely, around the outer circumference of the first sidewall or the inner circumference of the second sidewall. In case, the shaping is provided in the first sidewall, it is preferably directed outwardly, i.e. towards the second sidewall. In case the shaping is provided in the second sidewall, it is preferably directed inwardly, i.e. towards the first sidewall.

This shaping can be produced by any technique known by a person skilled in the art, e. g. by folding or any other method of plastic deformation. Preferably, the shaping is inserted into the segment, preferably the cardboard segment before it is formed, e. g. rolled into the final shape of the sidewall. More preferably, the shaping is an embossment, which is produced for example by applying locally pressure on the sidewall and deforming the material of the sidewall plastically. The shaping can have any form known by a person skilled in the art. However, preferably, it is compressible, at least partially, especially in case an axial-force is applied to the sidewall. Preferably the shaping is U-shaped or has partially the shape of a segment of a circle. In a preferred embodiment, the shaping is compressed in its height extension, i.e. after the compression of the shaping, the sidewall is reduced in its height. Due to the compression of the shaping in its height, preferably the radial extension of the shaping increases at least partially. More preferably, the compression of the shaping is elastic, i.e. as soon as the deformation force is removed, the shaping resumes, at least partially, its original shape. Thus, in this preferred embodiment of the present invention, the deformed shaping functions as a spring.

In another preferred embodiment of the present invention, the flanges and/or edges of the shaping are bonded, preferably glued or sealed, together after they have been compressed.

According to another preferred embodiment, the second sidewall is utilized to maintain the shapings in their compressed state. Thereto, the two sidewalls are preferably connected in two or more different areas, especially at two or more different heights of the container. The shaping itself or other parts of the first sidewall can be connected to the second sidewall. Preferably, the second sidewall is subjected to a tension, especially an axial tension. This tension increases the stiffness of the first and/or second sidewall. This tension is preferably introduced into the second sidewall due to the connection of the first sidewall to the second sidewall and the spring-like behavior of the compressed shaping in the first sidewall.

In another preferred embodiment, the spacer is a rim which is preferably located at the lower end of the first or second sidewall.

In order to also attain the above described objective, a container with a first sidewall and a base which is connected to the first sidewall is provided, whereas the first sidewall and the base comprise an outwardly directed bevel at their lower end.

The disclosure made to this embodiment of the present invention also applies to other embodiments of the present invention and vice versa.

According to the present invention, the first sidewall and the base now comprises an outwardly directed bevel at their lower end. This bevel increases the stand-up stability. Preferably, the bevel is plastically formed into the first sidewall and the base after they have in connected preferably glued or sealed together. Preferably, the bevel is arranged at an angle between 30 and 60° preferably 40-50° and most preferably 45° relative to a vertical axis.

In a preferred embodiment of the present invention, the container comprises a second sidewall, which is arranged around the first sidewall under the formation of a gap between the first and the second sidewall. In a more preferred embodiment, the bevel now provides a finish for the second sidewall. This preferred embodiment of the present invention reduces the risk, that the user of the container injures himself at the lower edge of the second sidewall.

According to another inventive or a preferred embodiment of the present invention, a container, particularly a cup, is provided with a base, a first sidewall and a second sidewall arranged around the first sidewall, whereas the second sidewall is seal and/or glued to the first sidewall and/or the base in two different sealing regions which extends around the entire circumference of the first sidewall.

The disclosure made to this embodiment of the present invention also applies to other embodiments of the present invention and vice versa.

The inventive container has the advantage that due to the extension of the sealing regions around the entire circumference, the second sidewall provides additional leak resistance.

Another embodiment of the present invention is a process for making the sidewall of a container by:

providing a sidewall-segment of a cup which is formed and whose ends are connected by a seam, Introducing, before, during or after, forming a shaping into the sidewall-segment having at least one circumferential portion which is directed inwardly or outwardly, compressing the shaping at least partially in its height and securing the compressed shape of the shaping.

The disclosure made to this embodiment of the present invention also applies to other embodiments of the present invention and vice versa.

According to the inventive process, a preferably flat sidewall-segment is provided and formed, for example, into a conical shape. After or while it is formed, two, preferably opposite, ends are connected, for example by gluing or sealing. Before, during or after this forming, a shaping is introduced into the sidewall, whereas an introduction of the shaping prior to forming is preferred. Subsequently, the shaping is at least partially compressed in its height, so that the overall height of the sidewall decreases and the compressed state of the shaping is fixed.

The shaping is preferably introduced into the sidewall-segment by embossing.

The fixation of the shaping in its compressed state is preferably executed by providing a second sidewall which is connected to the first sidewall. More preferably, the second side wall is connected to the first sidewall at two different heights, whereas the shaping is located between these connection-areas.

Preferably, a second shaping is arranged in the first sidewall which is more preferably parallel to the first shaping.

Preferably, the shaping is done by embossing.

Another subject matter of the present invention is a process for the production of the inventive container, whereas the bevel is plastically formed into the container after the base has been attached to the first sidewall.

The disclosure made to this embodiment of the present invention also applies to other embodiments of the present invention and vice versa.

Another subject matter of the present invention is a tool for the insertion of a bevel into a container which comprises an axially displaceable ambos with a circumferential wall with a slope at its base.

The disclosure made to this embodiment of the present invention also applies to other embodiments of the present invention and vice versa.

By displacing the tool axially, the ambos is pressed against the lower end of the container and plastically forms the bevel into the lower end of the container, i.e. in the first sidewall and in the base. The circumferential sidewall here serves as guidance, while the slope takes care of the plastic deformation.

The inventions are now described in further detail according to the figures. The description applies to all inventions, respectively. The description does not limit the scope of the present inventions.

DESCRIPTION OF THE SEVERAL VIEWS OF THE DRAWING

FIG. 9 a partial sectional view of a shaping.

DETAILED DESCRIPTION OF THE INVENTION

Figure 1:
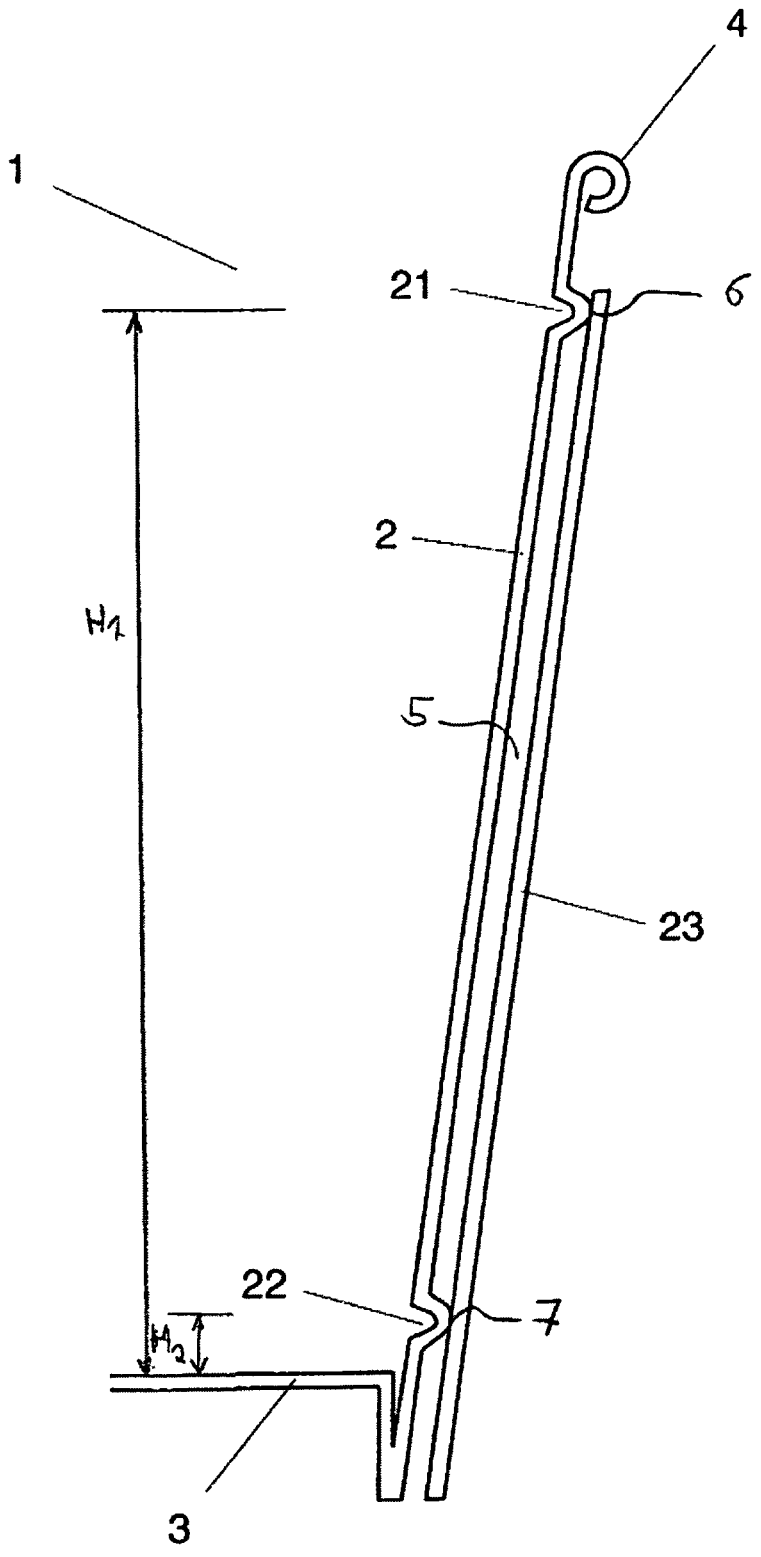
FIG. 1 is a partial sectional view of a first embodiment of the inventive container having first and second shapings.

FIG. 1 depicts a first embodiment of the inventive container 1, in the present case a cup, with a conically shaped first sidewall 2 and a bottom 3, which is a separate part and attached to the first sidewall 2. The container 1 is entirely made from paper or cardboard. The first sidewall and the bottom 3 form a volume which can be filled with an item, for example a beverage, such as coffee, tea or a cold drink or a food, such as soup or mash or porridge. The wall 2 has an upper rim 4, located opposite to bottom 3. The sidewall comprises a first, here circumferential, shaping 21 and a second, here also circumferential, shaping 22, which are both plastically embossed into the material of the first sidewall. At least one, here both, shapings are compressed in their height, as further explained according to FIGS. 2*a-c* and FIG. 9. The first shaping 21 is introduced into the sidewall at a height H1 and the second shaping is introduced at a different height H2. In the present case the shapings are located near rim 4 and bottom 3. However, it can be also advantageous to move the shapings 21, 22 closer together and/or more towards the middle of the container. Both shapings 21, 22 are oriented outwardly. Due to the compression, both shapings 21, 22 are reduced in their height h and increased in their radial extension $r_x$. The compression is carried out elastically, so that, as soon as the compression force is removed, the shapings try to recover, at least partially, their original shape. Thus, the shapings 21, 22 act as a spring. In order to secure the shapings 21, 22 in their compressed state, the container according to the present example comprises a second sidewall 23, which is sealed or glued to the first sidewall 2, here to the tips of the shapings 21, 22 at the connection points 6, 7, respectively. While the second sidewall 23 is attached to the first sidewall 2, the shapings 21, 22 are held in their compressed shape by an external force until the connection 6, 7 is sufficiently rigid. Due to the spring-like behaviour of the shapings 21, 22, the first sidewall 2 is, between the connections 6, 7, subjected to a compressive force and the second sidewall is subjected to a tension force. Both forces improve the stability of sidewall, respectively. Between the first and the second sidewall an air gap 5 is provided which improves the insulation of the inventive cup. The shapings 21, 22 act here also as spacers between the two sidewalls 2, 23. The connections 6, 7 extend preferably around the entire circumference of the first sidewall 2 so that in case of a leak in the first sidewall 2 between the connections 6, 7, the second sidewall will provide additional leak resistance.

Due to the airspace 5, even in case the cup is filled with a hot fluid, the temperature on the outer surface of the second sidewall 23 is relatively low, because of the good isolation.

The person skilled in the art understands, that it can be sufficient to provide only the first shaping 21. In this case, the second sidewall 23 is connected to the shaping 21 or above shaping 21 and in an area below shaping 21.

The second sidewall 23 can extend to the bottom end of the first wall 2 as depicted in FIG. 1. It is, however, also possible to provide a distance between the lower end of the second sidewall 23 and the bottom-end of the first wall 2. In both cases the bottom edge of the second wall 23 and/or the bottom edge of the first sidewall 2 can be used as a stacking shoulder. It is also possible that a further shaping, for example a ring, is arranged near the bottom end of the first sidewall which can be used as a stacking shoulder. This ring can be formed by a compressed shaping and can be arranged directly adjacent the lower shaping 22 and is preferably directed inwardly.

The inventive container is preferably produced by providing a flat segment for the first sidewall and embossing the embossments 21, 22 into this segment, while it is still flat. Subsequently, the segment is formed into a conus and the opposite ends of the segment are glued or sealed together. Afterwards, the embossments 21, 22 are compressed in their height, respectively, by applying a compression force. While the embossments are maintained in this compressed state, the second sidewall 23 is attached to the first sidewall, for example by gluing. Preferably, the second sidewall is provided as a flat segment and then wrapped around and attached to the first sidewall 2. After the connection between the first and the second sidewall is sufficiently rigid, the compression force can be removed and the inventive container is finalized.

It is, however, also preferable to provide the second wall 23 as an entire cup or as a formed conus and to insert sidewall 2 and bottom 3 into this second cup or conus and fix them.

The shapings 21, 22, 26, 27 and 28 can be introduced into the respective sidewall 2, 23 after the sidewall has been formed, for example, in the shape of a conus.

In order to compress the shaping an inner arbour and an outside tools can be used.

Figure 2A:
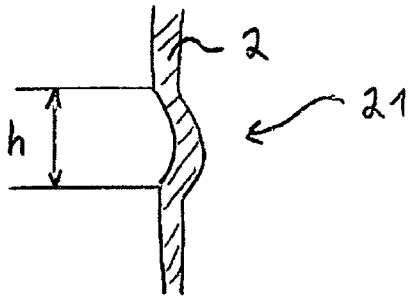
FIGS. 2*a-c* are partial sectional views illustrating the compression of the shapings.
Figure 2B:
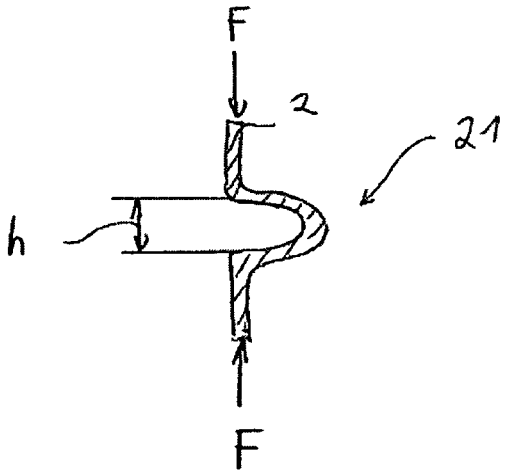
Figure 2C:
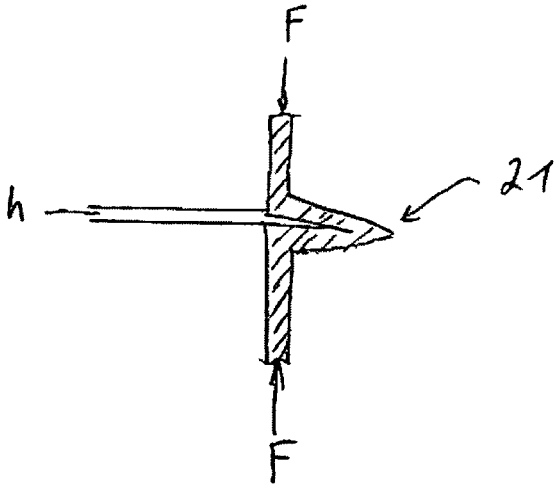
Figure 3:
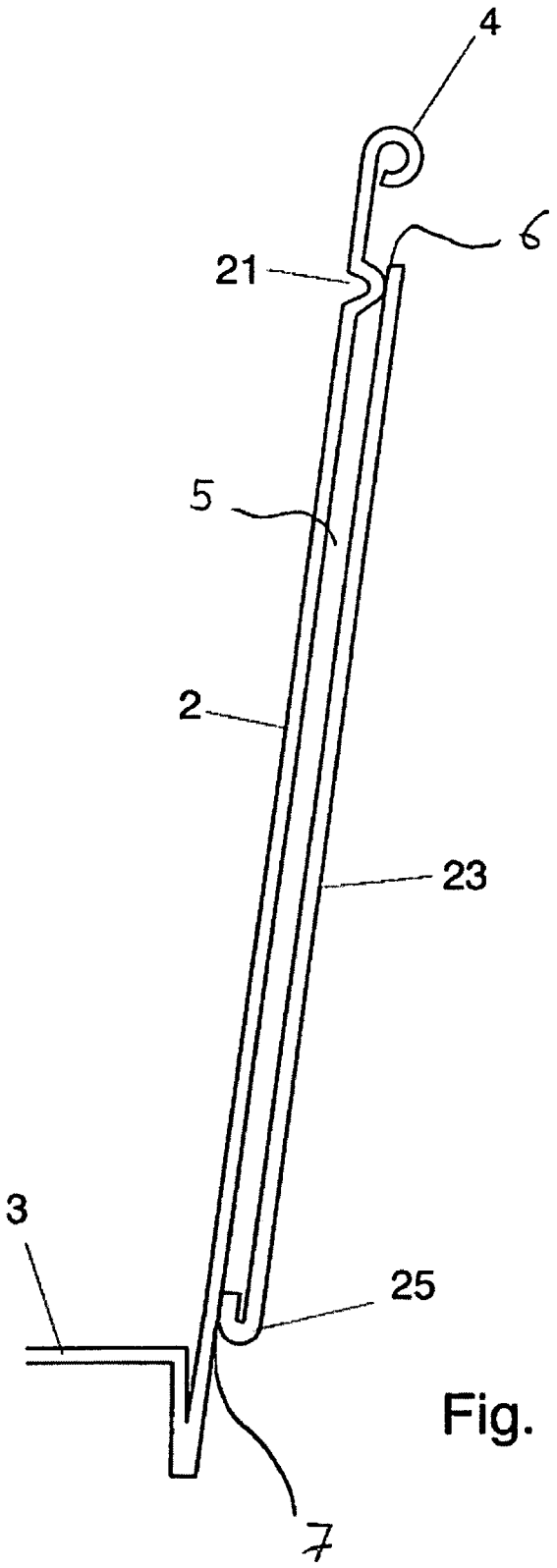
FIG. 3 is a partial sectional view of a second embodiment of the inventive container.

As can be seen from FIG. 2, the shaping 21, here a plastic embossment, has initially a certain height h. This shaping, here the embossment 21, is then compressed (FIG. 2*b*), at least partially, elastically by applying a compression force F. Due to this force F the height of the shaping is reduced and the radial extension of the shaping 21 is increased. As can be seen in FIG. 3, the compression of shaping 21 can be further increased, until the flanks of the shaping 21 and/or the edges 8 of the shaping touch each other at least partially. Ring 21 is now flat. As soon as force F is removed, the shaping 21 tries to recover, at least partially, its shape as depicted in FIG. 2*a*, so that is acts as a spring. Thus, the shaping has to be secured in their compressed shape.

Another embodiment of the container according to FIG. 1 is depicted in FIG. 3. Reference is made to the disclosure regarding FIG. 1. In this case the second shaping has been replaced by a rim 25 at the lower edge of the second sidewall 23, which acts as a spacer and which is connected to the first sidewall. The connections 6, 7 extend preferably around the entire circumference of the first sidewall 2 so that in case of a leak in the first sidewall 2 between the connections 6, 7, the second sidewall will provide additional leak resistance.

Figure 4:
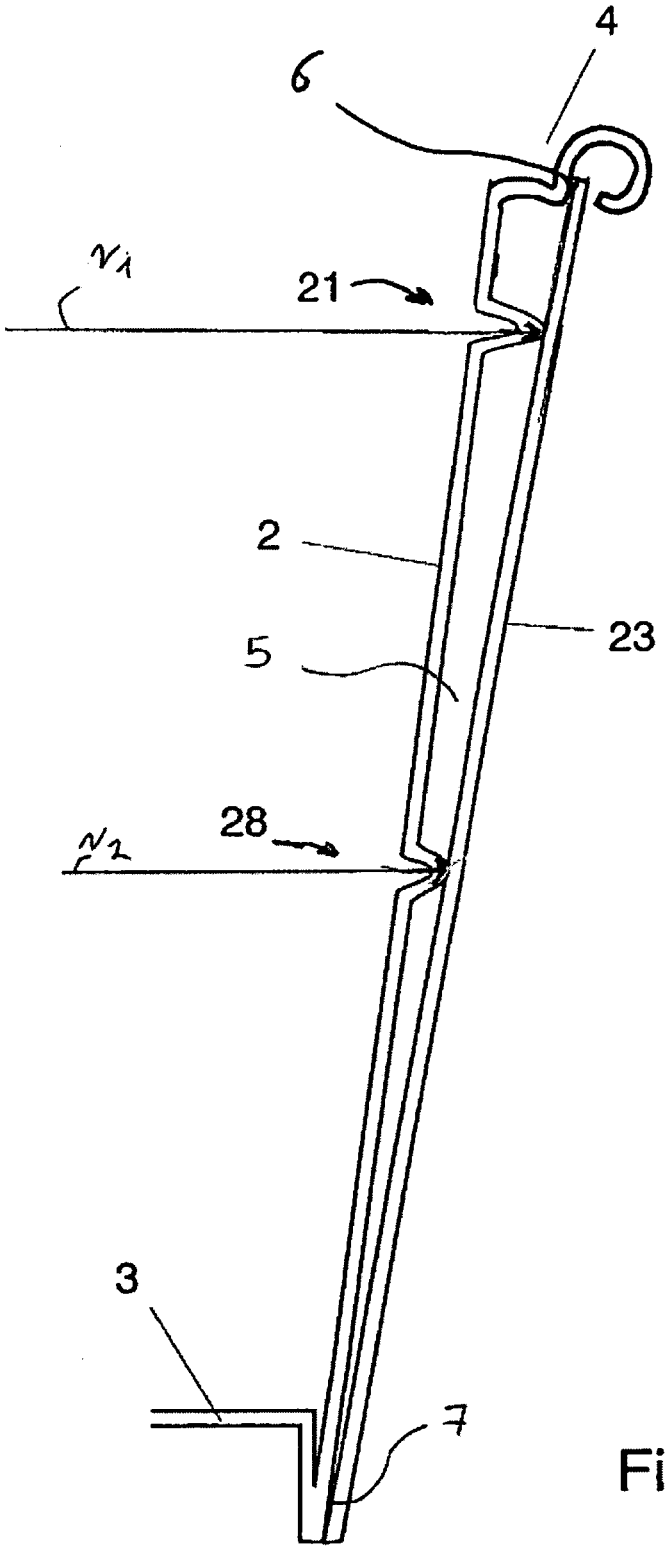
FIG. 4 is a partial sectional view of a third embodiment of the inventive container.

Another embodiment of the container according to FIG. 1 is depicted in FIG. 4. Reference is made to the disclosure regarding FIG. 1. In this case the second shaping 28 is moved toward the middle of the container and the second shaping 28 has a smaller radial extension $r_2$ than the radial extension $r_1$ of the first shaping 21. The second sidewall 23 is, in the present case attached to the first sidewall 2 in the vicinity of rim 4 and at the lower end of the first sidewall 2 and the second sidewall 23 has a lager angle of inclination relative to the axis of rotation than the first sidewall 2. The connections 6, 7 extend preferably around the entire circumference of the first sidewall 2 so that in case of a leak in the first sidewall 2 between the connections 6, 7, the second sidewall will provide additional leak resistance.

Figure 5:
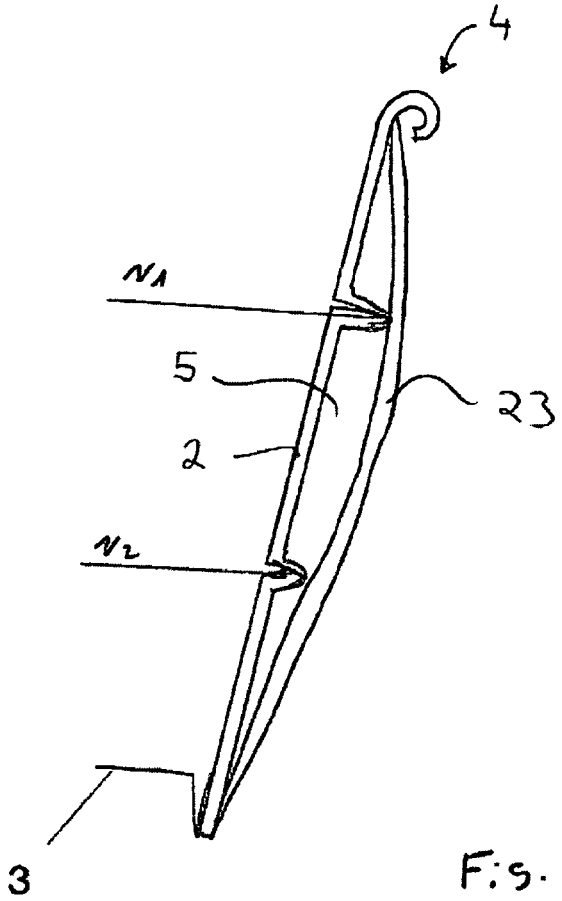
FIG. 5 is a partial sectional view of a forth embodiment of the inventive container.

FIG. 5 depicts essentially the embodiment according to FIG. 4. However, in this case, the second sidewall 23 is bent. Otherwise reference is made to disclosure regarding FIG. 5.

Figure 6:
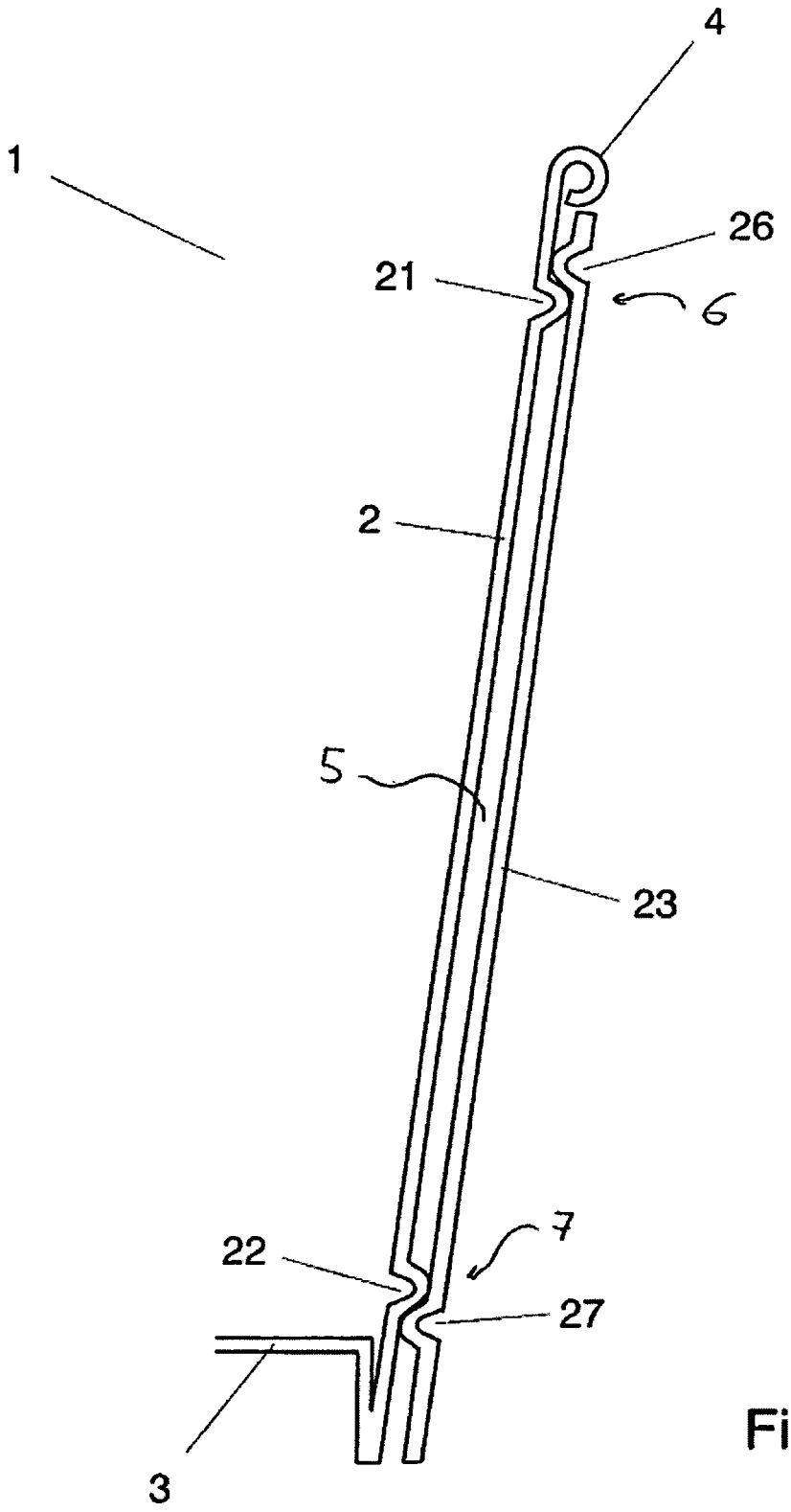
FIG. 6 is a partial sectional view of a fifth embodiment of the inventive container.

In FIG. 6 the second sidewall 23 comprises shapings 26 and 27 which correspond in shape and location with the shapings 21, 22 and are thus able to secure the shapings 21, 22 in their compressed state. The connection between the shapings 26, 27 and shapings 21, 22 is preferably purely mechanical. However, a combination of mechanical connection and glued, sealed or welded connection is also preferred. Otherwise reference is made to the disclosure made regarding FIG. 1.

Figure 7:
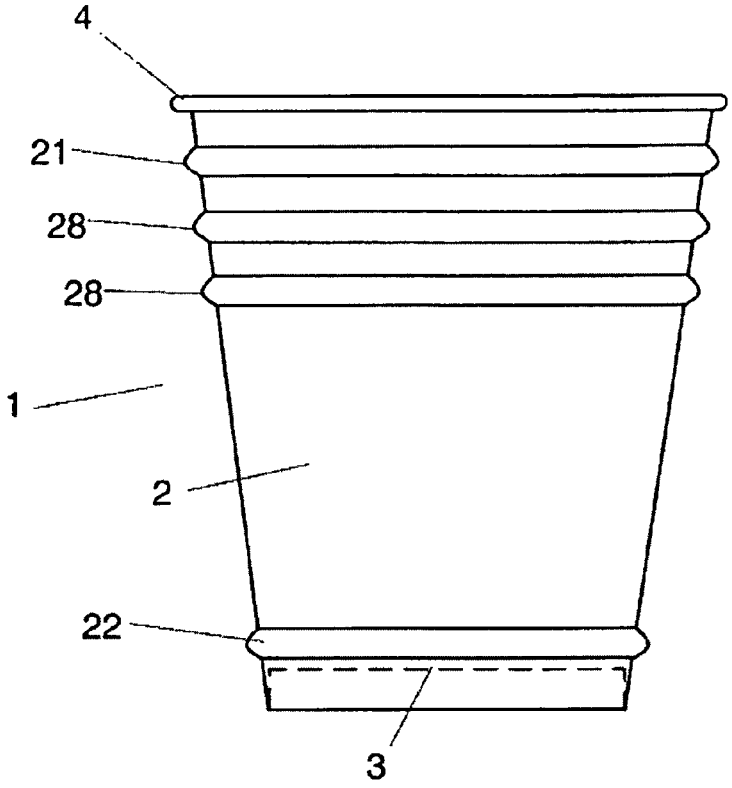
FIG. 7 is a side view of an embodiment of the inventive container with a multitude of shapings.

Reference is now made to FIG. 7. In the first sidewall 2 as well as in the second sidewall 23 other shapings 28 can be provided, which may point in any direction and which can be also compressed. Such additional shaping 28 can be used, for example, as a spacer between the first sidewall 2 and the second sidewall 23, and/or it can be provided to increase the stiffness of the respective sidewall.

Figure 8:
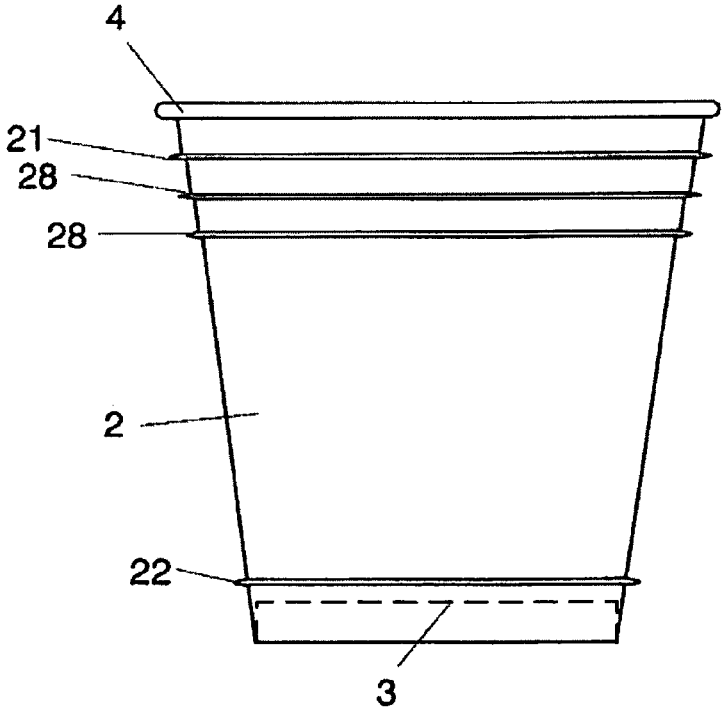
FIG. 8 is a side view of the embodiment of FIG. 7 after the shapings have been compressed.
Figure 3:
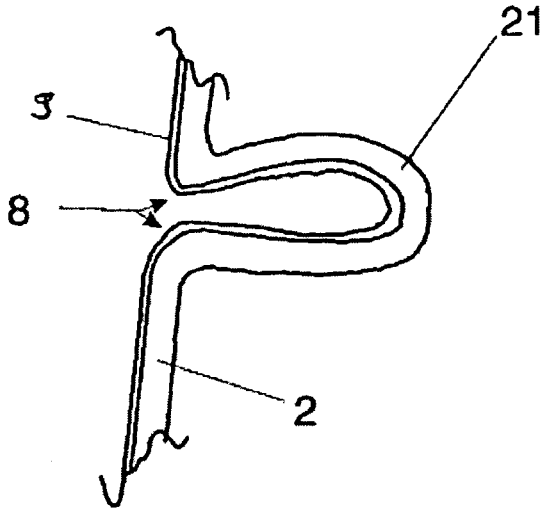

FIG. 8 shows the container according to FIG. 7 with compressed shapings 21, 22 and 28.

Referring now to FIG. 9, the sidewalls 2 or 23 as well as the bottom 3 are made of paper, cardboard or fibrous material or a combination thereof and are provided on the inside, for example, with a PE coating 9. For the coating 9 other known materials, also recyclable materials, are applicable. These materials need not be sealable. The coating 9 can be applied on the entire surface or partially. It should be, however, applied at least onto the complete internal surface of the cup 1, because then the softening of the wall 2 is prevented in case the base material is a not resistant against the contents of the container.

Figure 10:
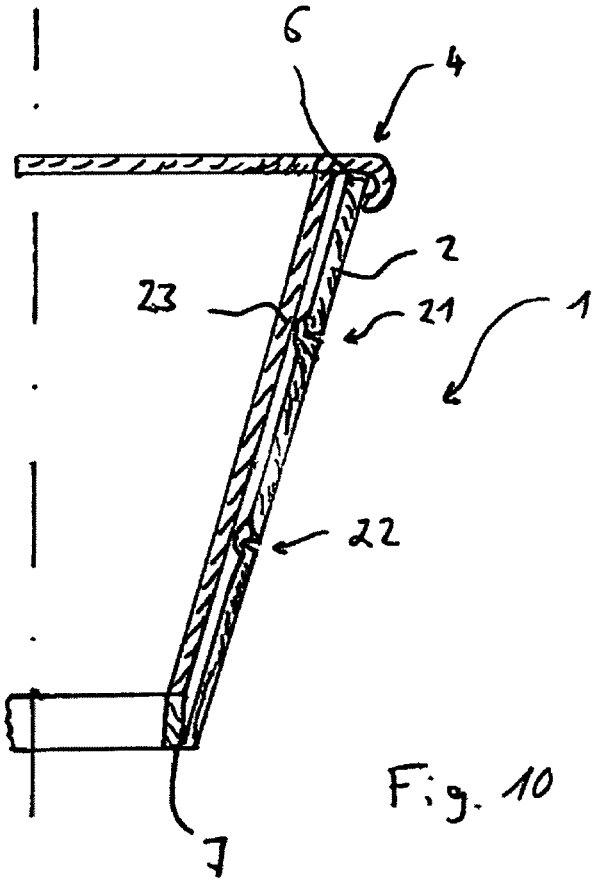
FIG. 10 is a partial sectional view of yet another embodiment of the inventive container.

FIG. 10 shows yet another embodiment of the present invention. In this case the sidewall with the shaping is placed outside of the inner sidewall. The shaping is preferably compressed. The sidewalls are connected at two positions 6 and 7. Other than that, reference is made to the other figures and their description.

In general, the circumferential ring/sharpening strengthens the sidewall 2, 23 of the cup 1. An undesired compression by the user of the cup 1 cannot take place anymore. Alternatively or additionally, the material strength of the sidewalls 2, 23 can be reduced and/or a less rigid material can be used.

In case an outwardly directed shaping is introduced into the outer sidewall, it prevents that the cup 1 slips out of a user's hand unintentionally.

According to the present invention, it is possible to provide a cup 1 which shows a double-walled and very stable structure with a low weight. Packaging with different shapes, can also be produced, for example angular, oval or containers with other cross sections.

Figure 11:
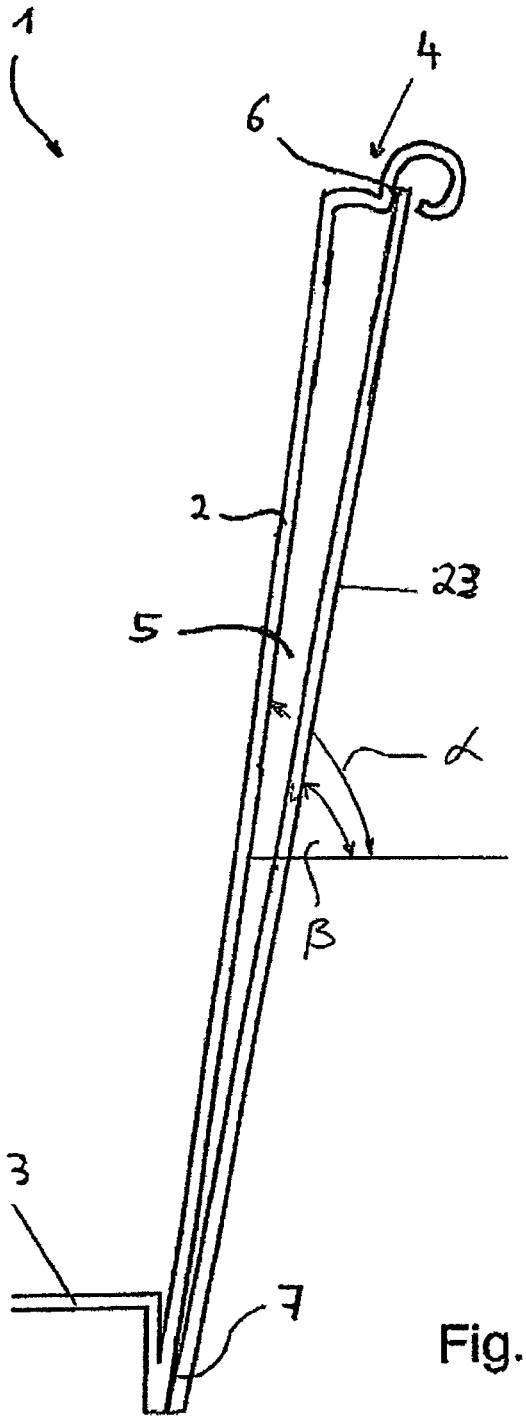
FIG. 11 is a partial sectional view of another embodiment of the inventive container.

FIG. 11 shows the inventive container 1, which comprises a first sidewall 2. The first sidewall 2 comprises at its upper end a rim 4 and is at its lower end connected to a bottom 3. The first sidewall 2 is in the present case made from a flat cardboard-segment, which has been formed into a conus and whose opposite ends have been glued to each other. Around the circumference of the first sidewall, a second sidewall 23 is arranged, which is connected at the rim 4 and the lower end of sidewall 2 at the connection areas 6 and 7. The second sidewall is also made from a flat cardboard-segment, which is rolled around the circumference of the first sidewall and formed into a conus. According to the present invention, the angle of inclination a of the first sidewall is now larger than the angle of inclination (3 of the second sidewall.

Due to this difference in angle of inclination a gap 5 is formed between the two sidewalls. The inventive container is in the present case made from cardboard and comprises at least at its surfaces, which are in direct contact with the food or beverage filled into the container, with a coating, to increase the time period in which the inventive container is not softened.

Figure 12:
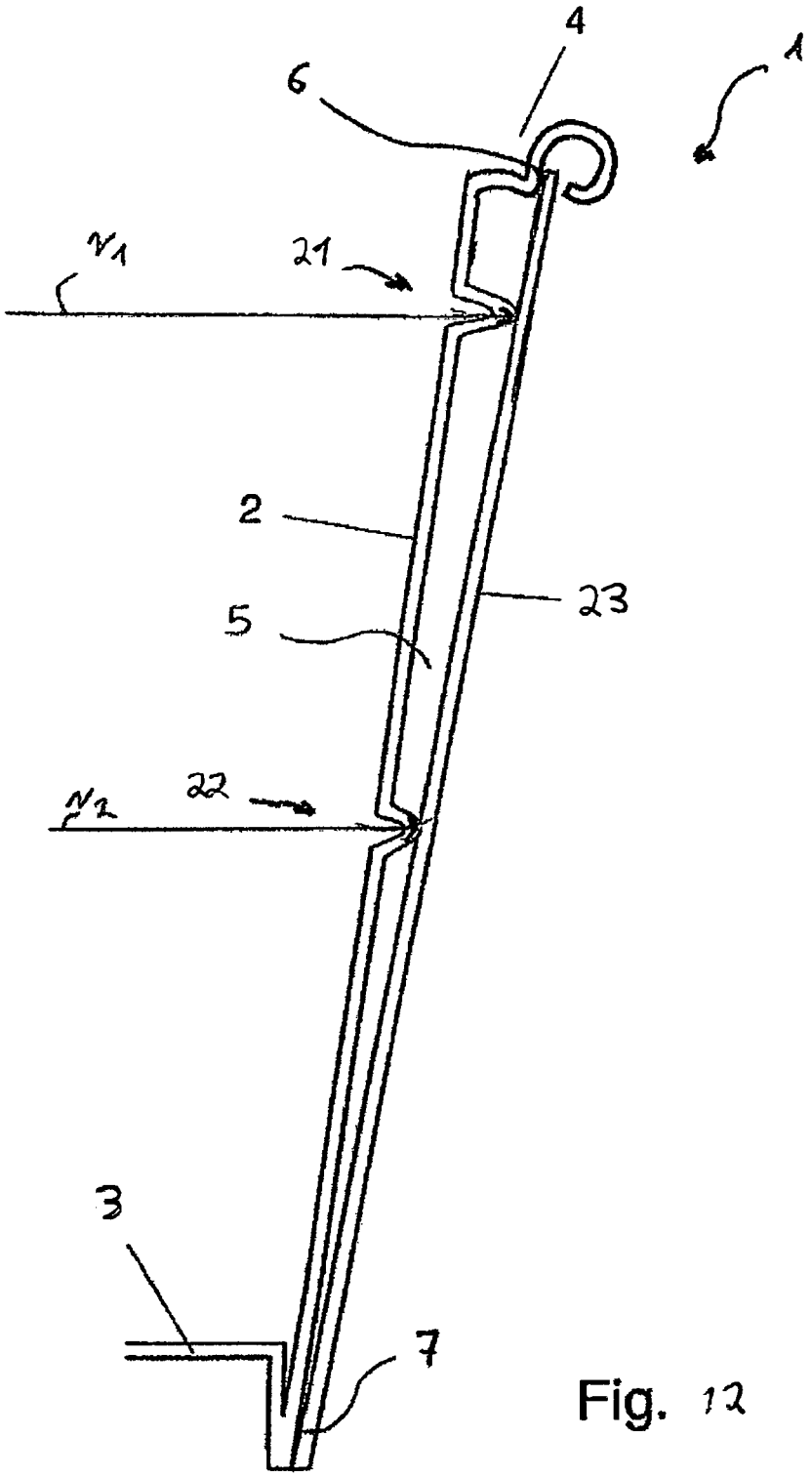
FIG. 12 is a partial sectional view of yet another embodiment of the inventive container.

FIG. 12 shows essentially the container according to FIG. 11. However, in the present case, the first sidewall comprises at two different heights shapings 21, 22. The first shaping 21 has a larger radial extension $r_1$ than the radial extension $r_2$ of the second shaping 22. The shapings 21, 22 act as spacers between the first and second sidewall 2, 23, to assure, that the air gap 5 is maintained, even if the second sidewall is compressed, for example by the hand of a user. In the present case, the second sidewall is attached to the first sidewall at the connection areas 6 and 7. However, the person skilled in the art understands, that additionally or alternatively the second sidewall can also be attached to the tip of the shaping 21, 22.

Figure 13:
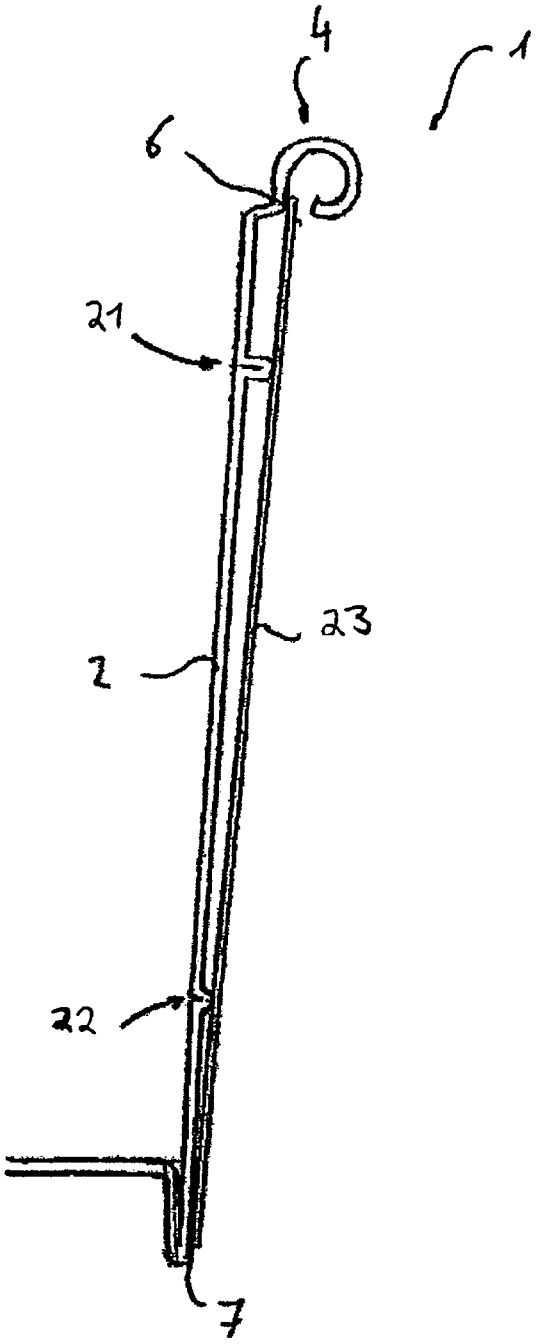
FIG. 13 is a partial sectional view of an inventive container with compressed shapings.

An alternative is depicted in FIG. 13. Here, the second sidewall 23 is utilized to maintain the shapings 21, 22 in their compressed state as depicted in FIG. 2*b* or 2*c*. This is done by compressing the shapings and holding the shaping in their compressed state, while the second sidewall is connected to the first sidewall either directly at the tip of the shaping 21, 22 or as here depicted in FIG. 13 at the rim 4 and at the lower end of the first sidewall 2. As soon as this connection 6, 7 is rigid, the shapings 21, 22 are maintained in their compressed state by the second sidewall 23. Additionally, the first sidewall 2 is subjected, at least locally, to a compressive force and the sidewall 23 is subjected, at least locally, to a tension, so that the entire construction is improved in its rigidity.

Figure 14:
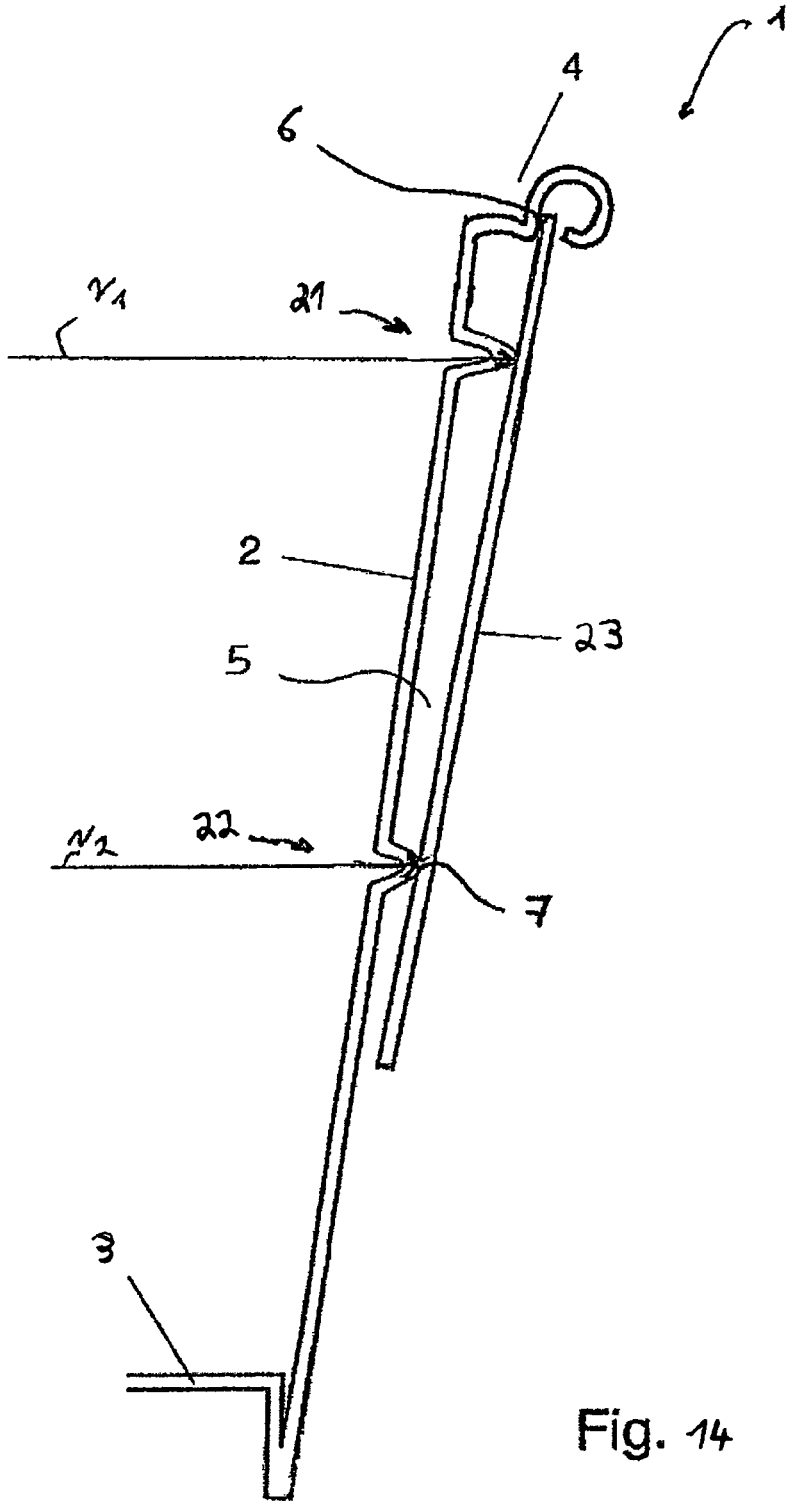
FIG. 14 is a partial sectional view of yet another embodiment of the inventive container.

FIG. 14 shows the embodiment according to FIG. 12 or FIG. 13, whereas in the present case, the second sidewall is reduced in its length and the second sidewall is here connected to the rim 4 and the tip of the second shaping 22.

Figure 15:
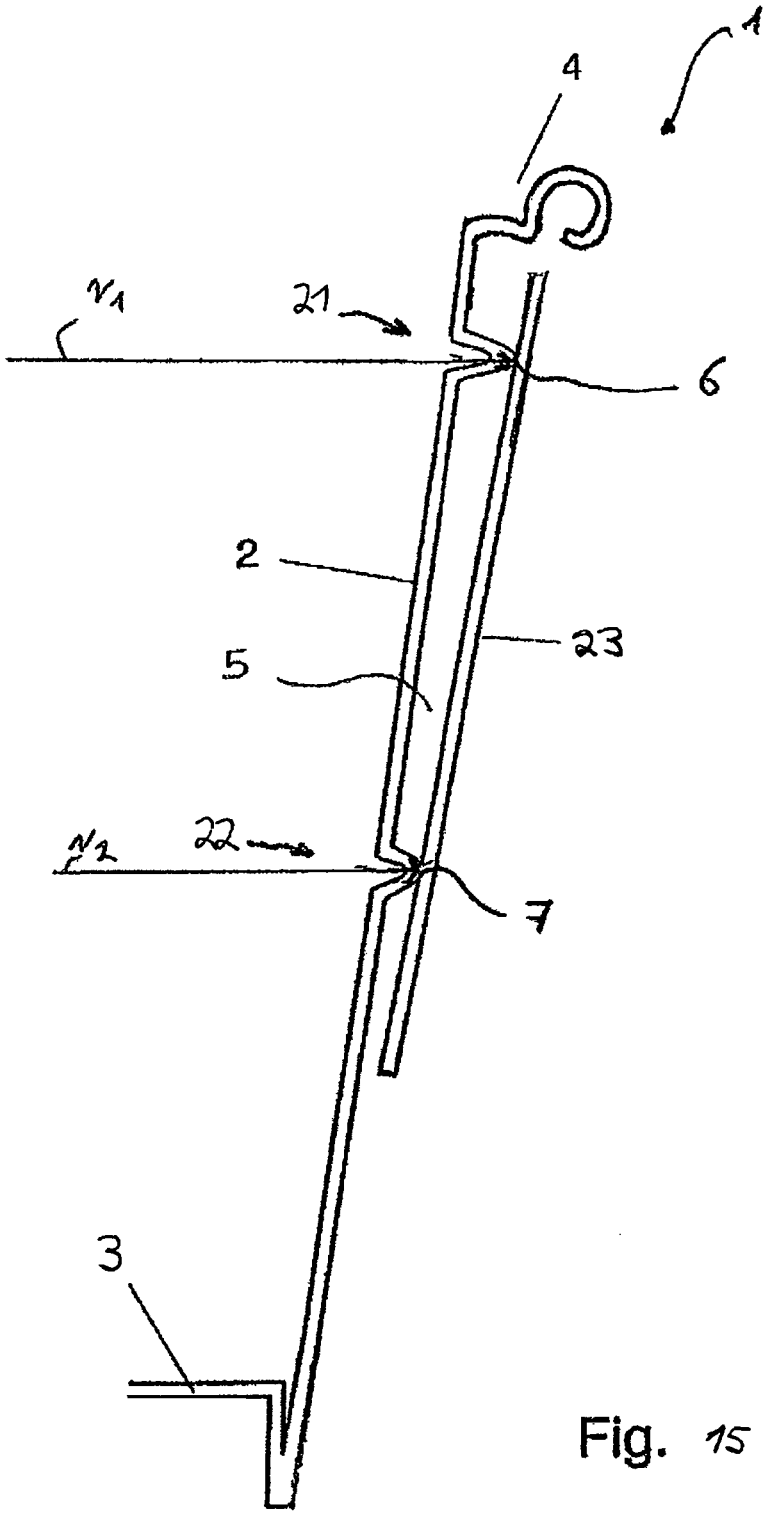
FIG. 15 is a partial sectional view of a modification of the container according to FIG. 14.

FIG. 15 shows a modification of the embodiment according to FIG. 14, whereas, in the present case, the second sidewall is attached to the first and second shaping 21, 22.

Figure 16:
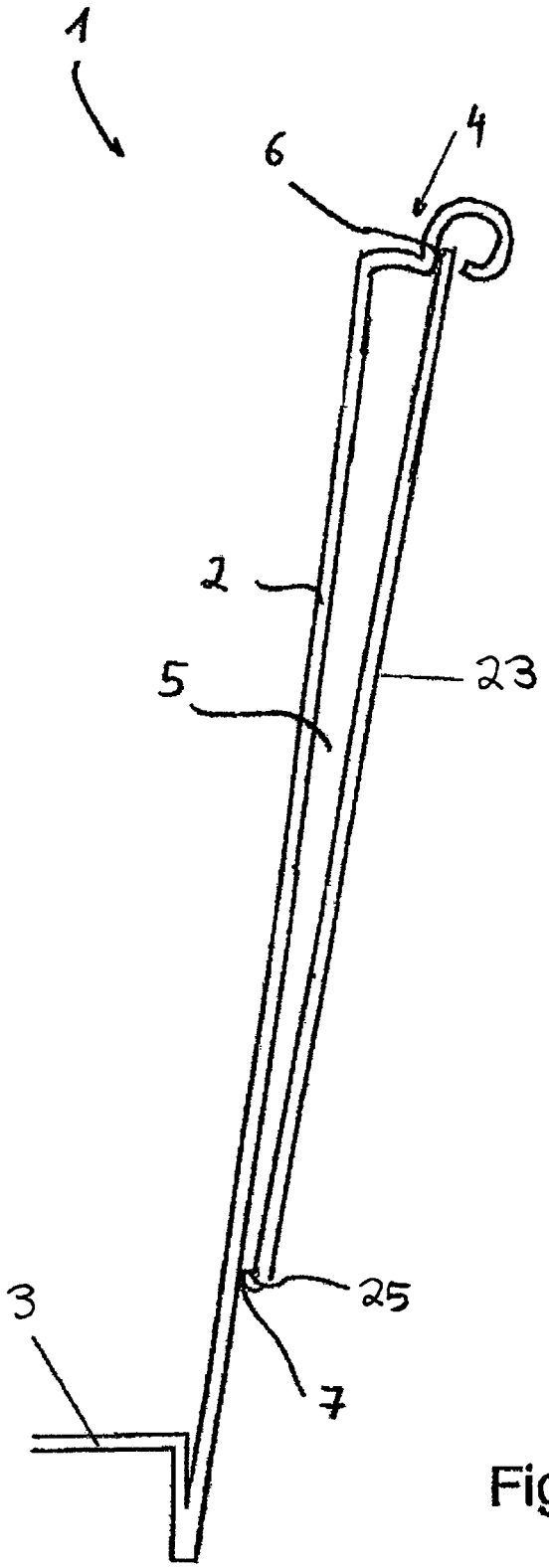
FIG. 16 is a partial sectional view of a container with a second sidewall with a rim at its lower end.

FIG. 16 shows a modification of the container according to FIG. 11. Here the second sidewall 23 has a shorter length and at it is lower and, a rim 25 is arranged as a spacer. The rim 25 is connected to the first sidewall at the connection area 7.

Figure 17:
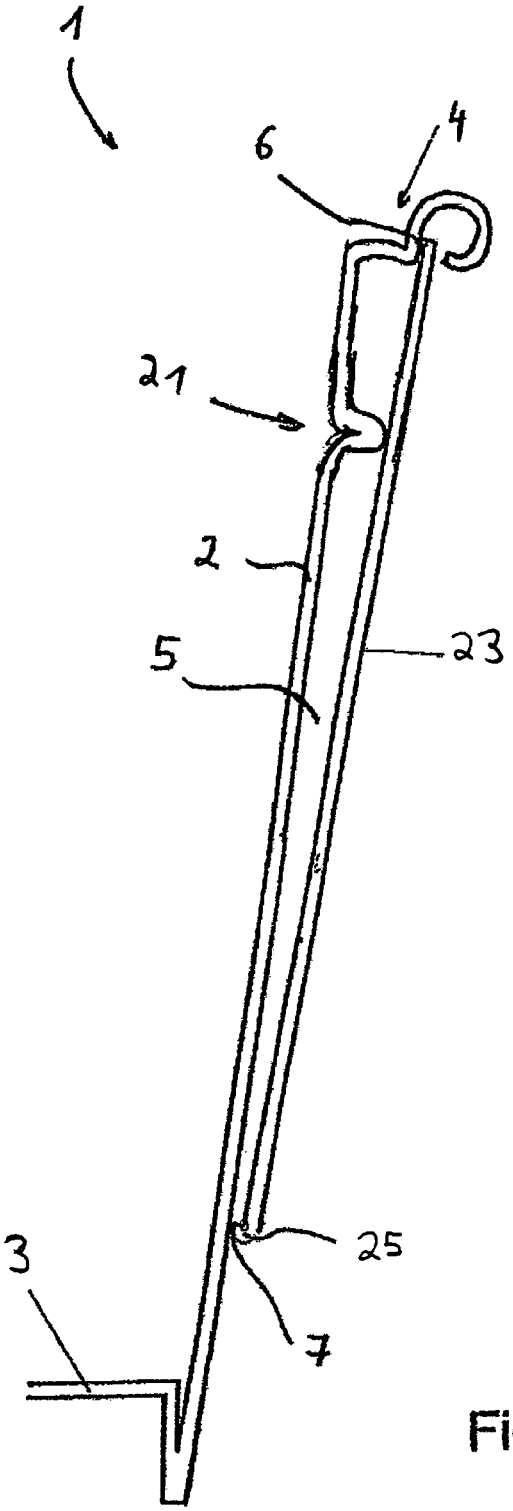
FIG. 17 is a partial sectional view of a container according to FIG. 14 with a shaping in the first sidewall.

FIG. 17 shows the embodiment according to FIG. 14, whereas here a shaping 21 is arranged in the first sidewall as an additional spacer and/or to subject the second sidewall to a tension.

Figure 18:
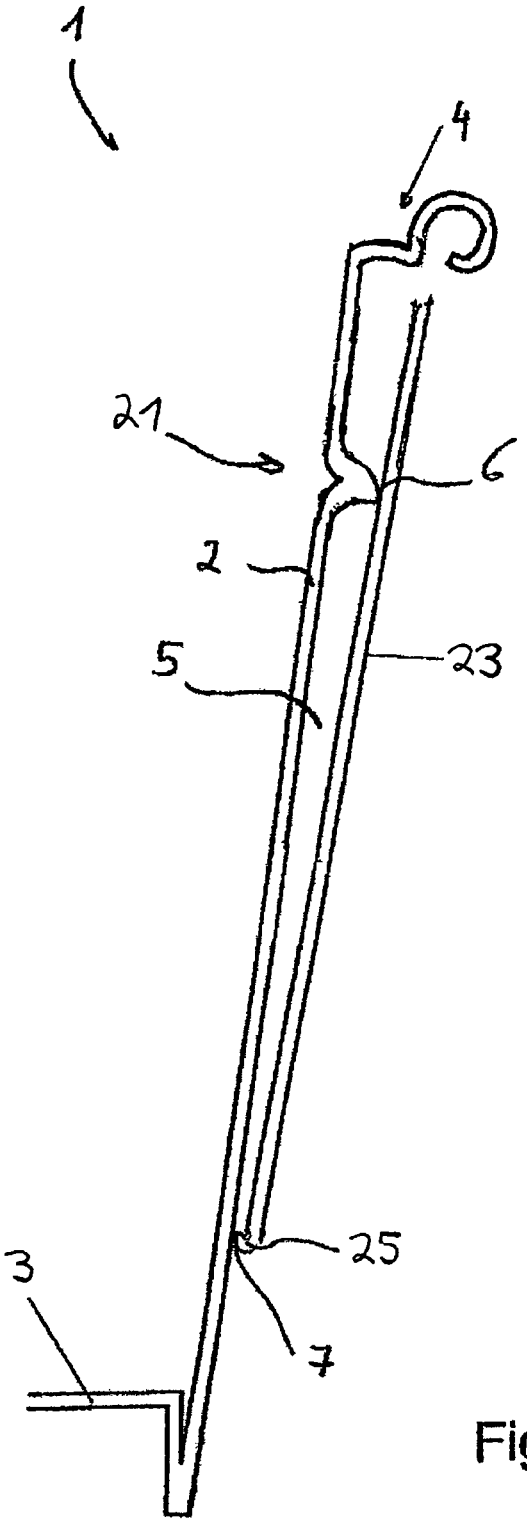
FIG. 18 is a partial sectional view of a modification of the container according to FIG. 17.

In FIG. 18 in modification of the embodiment according to FIG. 17 is shown, whereas, in the present case, the second sidewall does not touch the rim 4 of the first sidewall and is connected with its rim 25 to the first sidewall at the connection area 7.

Figure 19:
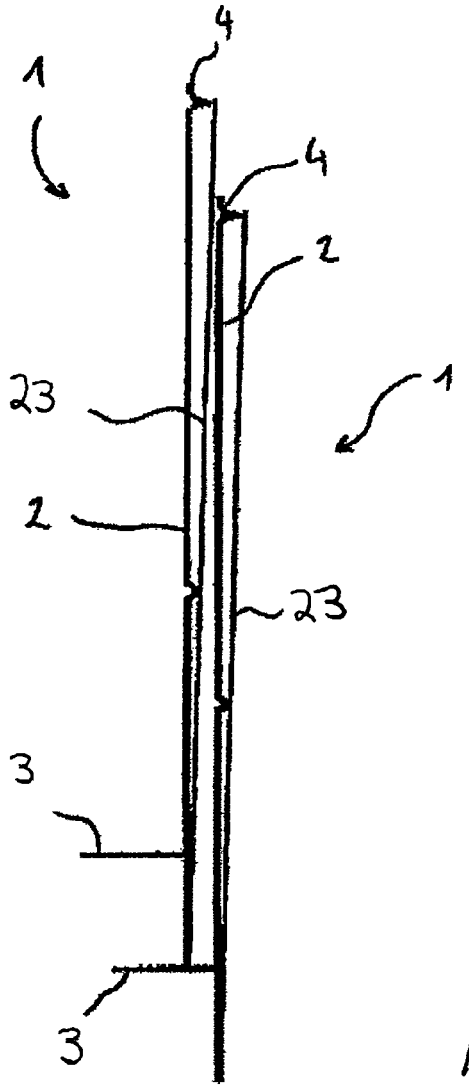
FIG. 19 is a partial sectional view of two stacked containers.

FIG. 19 shows two stacked containers 1. Due to the lower angel of inclination of sidewall 23 in comparison to sidewall 2, the two containers 1 do not interlock.

Figure 20:
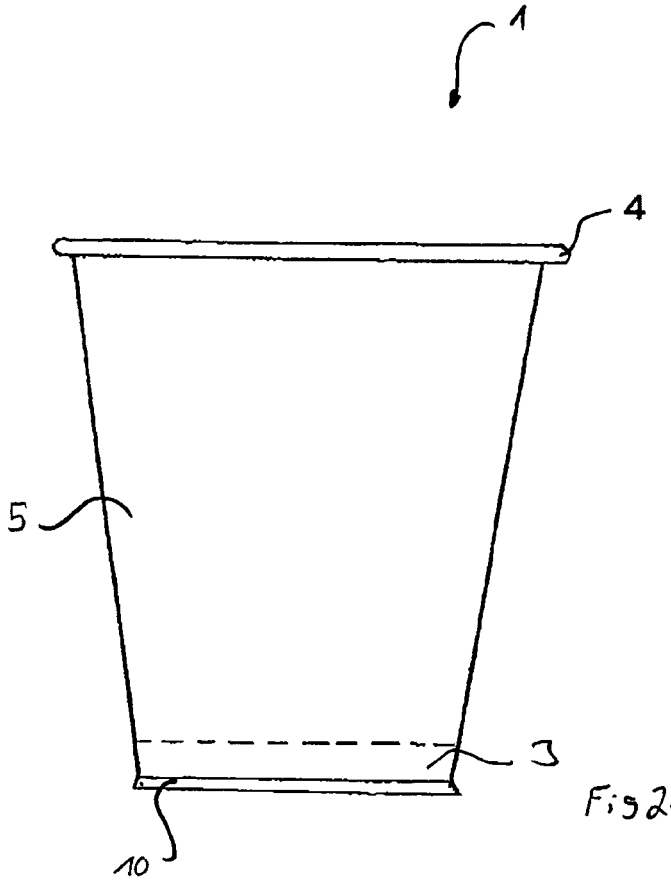
FIG. 20 is a side view of an inventive cardboard container.

FIG. 20 shows the inventive container 1, here a cardboard container, which has a first sidewall 2. This sidewall has at its upper end an upper rim and is at its lower end connected, preferably glued or sealed to a base 3. The base 3 and the sidewall 2 define the filling volume of the container 1. According to the present invention, a bevel is now plastically formed into the lower end of the sidewall and the base. The bevel extents outwardly and does increases the area on which the inventive container stands. Thus, the stand-up stability of the inventive container 1 is increased.

Figure 21:
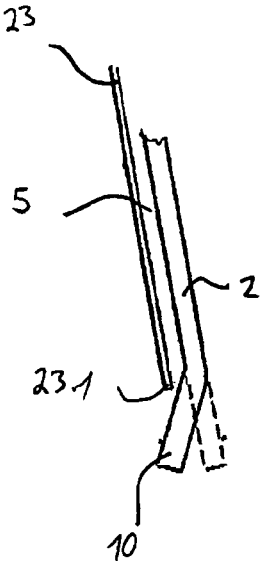
FIG. 21 is a sectional view of a detail of an inventive cardboard container with two sidewalls.

FIG. 21 shows a preferred embodiment of the present invention. In this case, the inventive container comprises a second sidewall 23, which is arranged around the first sidewall under the formation of a gap preferably an air gap 5. The second sidewall 23 ends above the lower end of the first sidewall 2 and/or the base 3. As can be seen in FIG. 2, the bevel 4 now provides a finish for the lower end 5.1 of the second sidewall 5. Thus, the lower end of the bevel is protected against mechanical influences and additionally, the user cannot hurt, for example cut himself at the lower end of the second sidewall 23.1.

Figure 22:
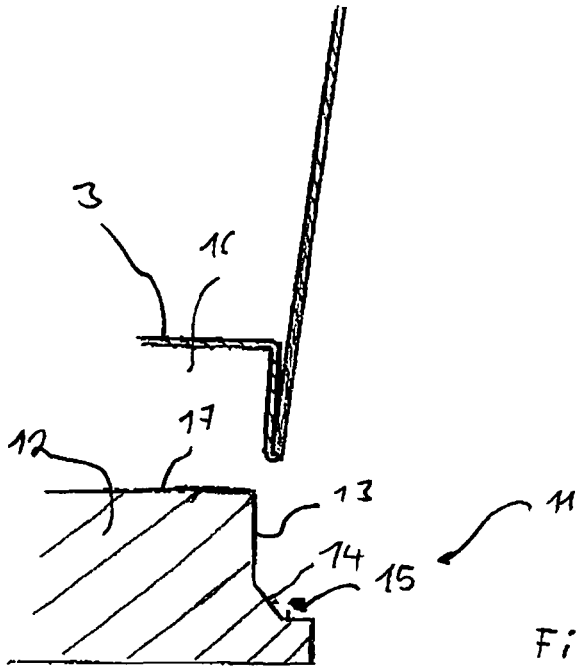
FIG. 22 is a partial sectional view of an inventive tool.

FIG. 22 shows the inventive tool 11, which comprises an axially displaceable ambos 12, as depicted by the double arrow. This ambos comprises a sidewall 13, which serves as a guiding means to ensure, that the ambos is placed centrally into the recess 16 of the base 3. Furthermore, the ambos 12 comprises at the lower end of the sidewall 13 a slope 14, which is in the present case, arranged under an angle of 45°.

Figure 23:
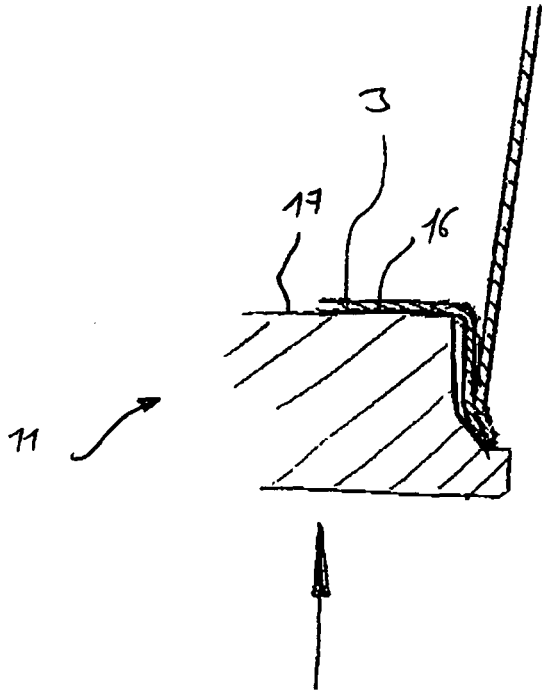
FIG. 23 is a partial sectional view of the formation of the bevel.

As can be seen form FIG. 23, for the formation of the inventive bevel, the tool 11 is moved toward the lower end of the inventive container and inserted into the recess 16 of the container until the upper end 17 of the ambos 12 touches the upper end of the recess. During the insertion of the ambos 12, the bevel is formed at the lower end of sidewall 2 and base 3.

LIST OF REFERENCE SIGNS

1 Packaging, container, cup
2 first sidewall, inner sidewall
3 base, bottom
4 upper rim, bent rim
5 gap, air gap
6 connection point, area
7 connection point, area
8 edge
9 coating
10 bevel
11 tool
12 ambos
13 circumferential wall
14 slope
15 base
16 recess
17 upper end of the ambos
21 first shaping, second embossment
22 second shaping, embossment
23 second sidewall, outer sidewall
23.1 lower end of the second sidewall
22 shaping, embossment
25 bent rim
26 securing means, embossment
27 securing means, embossment
28 second shaping, second embossment
F force, axial-force, pressure, compression force for the shaping
r radial extension of the shaping, embossment
h height, height extension of the shaping, embossment
Hx height of the container where the shaping is located
$r_1$ radial extension of the first shaping, first embossment 9
$r_2$ radial extension of the second shaping, second embossment 10
$\alpha$ angle of inclination of the first sidewall
$\beta$ angle of inclination of the second sidewall

The invention claimed is:

1. A container comprising:

a base, a first sidewall connected to the base, the first sidewall including a first circumferential shaping directed inwardly and/or outwardly, wherein the first circumferential shaping is configured into a compressed position so that an overall height of the first sidewall is reduced, wherein the first circumferential shaping acts as a spring with elastic behaviour so that the first circumferential shaping only maintains the compressed position due to an external force applied to the first circumferential shaping; and a second sidewall attached to the first circumferential shaping of the first sidewall at a first connection point thereby providing an air gap between the first sidewall and the second sidewall, wherein the second sidewall maintains the first circumferential shaping of the first sidewall in the compressed position by applying an external force to the first circumferential spacing.

2. Container according to claim 1, wherein the second sidewall is connected to said first sidewall at a second connection point, wherein the second sidewall is subjected to an axial tension, introduced into the second sidewall due to the elastic behaviour of the first circumferential shaping of the first sidewall and the maintained compressed position of the first circumferential shaping.

3. Container according to claim 1, wherein a connection between the first sidewall and the second sidewall is formed by at least one of gluing, sealing, welding and mechanical locking.

4. Container according to claim 3, wherein the first sidewall and the second sidewall are connected to one another at at least two different heights along the container.

5. Container according to claim 1, wherein a second circumferential shaping is arranged on the first sidewall at a height lower than the first circumferential shaping.

6. Container according to claim 5, wherein a radial extension of the first circumferential shaping is greater than a radial extension of the second circumferential shaping.

7. Container according to claim 1, wherein the first circumferential shaping is an embossment.

8. Container according to claim 1, wherein the first sidewall, the base and/or the second sidewall is provided at least on an internal surface with a coating, or an impregnation which makes the first sidewall, the second sidewall and/or the base at least temporarily resistant against humidity, liquid, oil and/or fat.

9. Container according to claim 2, wherein the tension in the second sidewall is provided between the first connection point and the second connection point.

10. Container according to claim 1, wherein a part of the first sidewall or the second sidewall can be detached.

11. Container according to claim 1, wherein the second sidewall is at least one of sealed and glued to the first circumferential shaping of the first sidewall at the first connection point.

12. Container according to claim 1, wherein the first circumferential shaping of the first sidewall includes a tip and wherein the second sidewall is glued to the tip of the first circumferential shaping.

13. Container according to claim 12, wherein the second sidewall has a secured diameter approximately equal to a diameter of the tip of first circumferential shaping when the first circumferential shaping is in the compressed position, and wherein the secured diameter of the second sidewall applies the external force to the first circumferential shaping to maintain the first circumferential shaping in the compressed position.

* * * * *